US011434444B2

(12) United States Patent
Zhang et al.

(10) Patent No.: US 11,434,444 B2
(45) Date of Patent: Sep. 6, 2022

(54) METHOD AND PROCESS FOR UPGRADING LIGNITE BY COLLABORATIVE OPTIMIZATION OF DRYING AND DRY SORTING

(71) Applicant: China University Of Mining And Technology, Xuzhou (CN)

(72) Inventors: Bo Zhang, Xuzhou (CN); Yuemin Zhao, Xuzhou (CN); Yadong Zhang, Xuzhou (CN); Guanghui Yan, Xuzhou (CN); Zhenfu Luo, Xuzhou (CN); Chenlong Duan, Xuzhou (CN); Liang Dong, Xuzhou (CN); Enhui Zhou, Xuzhou (CN)

(73) Assignee: CHINA UNIVERSITY OF MINING AND TECHNOLOGY, Xuzhou (CN)

( * ) Notice: Subject to any disclaimer, the term of this patent is extended or adjusted under 35 U.S.C. 154(b) by 11 days.

(21) Appl. No.: 16/972,396

(22) PCT Filed: Jun. 11, 2019

(86) PCT No.: PCT/CN2019/090619
§ 371 (c)(1),
(2) Date: Dec. 4, 2020

(87) PCT Pub. No.: WO2019/238020
PCT Pub. Date: Dec. 19, 2019

(65) Prior Publication Data

US 2021/0292672 A1 Sep. 23, 2021

(30) Foreign Application Priority Data

Jun. 14, 2018 (CN) ..... 201810619868.8

(51) Int. Cl.
*C10L 9/08* (2006.01)
*F26B 3/092* (2006.01)
*F26B 3/347* (2006.01)

(52) U.S. Cl.
CPC ..... *C10L 9/08* (2013.01); *F26B 3/092* (2013.01); *F26B 3/347* (2013.01)

(58) Field of Classification Search
CPC ..... C10L 9/08; F26B 3/092; F26B 3/347
See application file for complete search history.

(56) References Cited

U.S. PATENT DOCUMENTS

2005/0160667 A1* 7/2005 Weinberg ..... C10L 9/00 44/620
2010/0005710 A1* 1/2010 Shaffer ..... C10L 5/26 44/632

(Continued)

FOREIGN PATENT DOCUMENTS

CN 101705132 A 5/2010
CN 201560180 U 8/2010

(Continued)

OTHER PUBLICATIONS

PCT/CN2019/090619 Written Opinion dated Aug. 21, 2019 with English Translation.

(Continued)

*Primary Examiner* — Ellen M McAvoy
(74) *Attorney, Agent, or Firm* — Fishman & Associates, LLC.

(57) ABSTRACT

The present invention is directed towards a process for upgrading lignite comprising: prior to production pre-assess the calorific value of the coal, by selecting a relational expression between a calorific value of lignite and a degree of metamorphism, a moisture content and an ash content thereof based on a ratio of the ash content to the moisture content, pre-assess the calorific value of the coal; combining (Continued)

a relational expression between a production cost and the ash content and moisture content to make a cost budget; determining degrees of deashing and drying; selecting and implementing a lignite ash reduction pretreatment process; and implementing dry sorting first and then drying. The upgrading process has high sorting efficiency, high drying efficiency and low production cost, and meets the requirement for the surface moisture of the raw coal in the dry sorting operation.

4 Claims, 2 Drawing Sheets

(56) References Cited

U.S. PATENT DOCUMENTS

2010/0264720 A1* 10/2010 Mauger ..... C10L 1/326 299/5
2011/0265342 A1* 11/2011 Shi ..... F26B 3/084 34/82
2013/0340274 A1* 12/2013 Xu ..... C10L 9/08 34/380
2014/0054503 A1* 2/2014 Liu ..... C10L 1/326 44/280
2014/0196362 A1* 7/2014 Carnegie ..... C10L 9/08 44/608
2015/0027872 A1* 1/2015 Abe ..... C10L 9/08 202/151
2015/0047253 A1* 2/2015 Sato ..... C10F 5/06 44/608
2016/0264869 A1* 9/2016 Honjo ..... C10B 57/10
2016/0369194 A1* 12/2016 Duan ..... F26B 21/003
2017/0152455 A1* 6/2017 Koukios ..... C10L 9/00
2018/0237371 A1* 8/2018 Liang ..... C07C 55/02
2020/0238337 A1* 7/2020 Dong ..... B03B 4/005

FOREIGN PATENT DOCUMENTS

CN 102839032 A 12/2012
CN 108759313 A 11/2018
CN 108795527 A 11/2018

OTHER PUBLICATIONS

PCT/CN2019/090619 International Search Report dated Aug. 21, 2019 with English Translation.

* cited by examiner

METHOD AND PROCESS FOR UPGRADING LIGNITE BY COLLABORATIVE OPTIMIZATION OF DRYING AND DRY SORTING

TECHNICAL FIELD

The disclosure relates to the field of coal screening and sorting systems and processes, in particular to a process for upgrading lignite by collaborative optimization of drying and dry sorting.

BACKGROUND

Coal is the main energy source in China, where lignite totals about approximately 130.3 billion tons, accounting for 16% of the country's total coal reserves. In 2017, China's coal output was 3.52 billion tons, accounting for about 60.4% of the national energy consumption. Although the demand for coal resources is large, with the depletion of coal resources in the east and the large-scale development of high-rank coal, China has entered a period of low-rank coal resources development. The utilization of low-rank coal will become more and more important. However, lignite has a relatively high moisture content, with an average total moisture content of about 30%. It is difficult to meet the requirements of production and life in terms of calorific value, and the pollutants produced by lignite are several times those of high-rank coal. In addition, lignite is easy to weather and ignite spontaneously, which brings difficulties to long-distance transportation and long-term storage. Therefore, the large-scale upgrading of lignite resources is of great strategic significance for realizing the continuous supply of coal-based energy and ensuring the rapid and sustainable economic development in China.

Lignite features a low degree of coalification, a high moisture content, a high volatile content and a low calorific value, which determines that lignite must be upgraded through deashing and drying before it is used. Because lignite is easy to degrade in water, it is difficult to be upgraded by using a wet sorting process, which cannot achieve both deashing and drying and has complicated operation, high energy consumption and high production cost. As for deashing by dry sorting, it has strict requirements on the surface moisture of the raw coal. In addition, the existing single drying process of coal has problems such as high energy consumption, an unstable interface after drying, and easy re-adsorption of upgraded coal. It can only achieve partial water removal, and cannot achieve coal sorting.

SUMMARY

Purpose: In order to overcome the shortcomings existing in the prior art, an objective of the disclosure is to provide a process for upgrading lignite by collaborative optimization of drying and sorting. The upgrading process features simple operation, high sorting efficiency, low energy consumption and low production cost.

Solution: In order to achieve the above objective, the disclosure adopts the following optimized technical solution. A process for upgrading lignite by collaborative optimization of drying and dry sorting, including: selecting, optimizing and combining appropriate drying and dry sorting processes based on a relationship between a calorific value of lignite and a moisture content and an ash content thereof as well as a production cost required by a production process, and implementing the dry sorting process first and then the drying process, specifically including:

(1) before production, selecting a relational expression between the calorific value of the coal and a degree of metamorphism, the moisture content and the ash content thereof based on a ratio of the ash content to the moisture content, to pre-assess the calorific value of the coal; and (2) combining a relational expression between the production cost and the ash content and moisture content to make a cost budget, determining degrees of deashing and drying, and selecting a lignite ash reduction pretreatment process.

The relational expression between the calorific value of lignite and the ash content and moisture content thereof is as follows:

$$Q_{gr,d}=23.34-0.26285M_t-0.21954A_d+0.16979V_{ar}-0.00147V_{daf}^2 \quad (1)$$

In the equation, $Q_{gr,d}$ represents the calorific value of lignite, $M_t$ represents a total moisture content of the coal, $A_d$ represents the ash content of the coal, $V_{ar}$ represents the ash content of an as-received basis, and $V_{daf}$ represents a volatile content of a dry ash-free basis.

The relational expression between the production cost (S) and the ash content ($A_d$) and moisture content ($M_{ad}$) of the coal is as follows:

$$S = \omega \cdot M_{ad} + \gamma \cdot A_d \quad (2)$$

$$H_{MA} = \frac{\omega}{\gamma} \quad (3)$$

In the equation, $H_{MA}$ represents a tangent point between an iso-cost line and the calorific value, namely a lowest point of the production cost; S represents the production cost; $A_d$ represents the ash content of the coal; $M_{ad}$ represents the moisture content; ω represents a proportion of moisture removed during the sorting process; γ represents a proportion of ash removed during the sorting process.

The lignite ash reduction pretreatment process is a process of first preliminarily reducing ash and then deeply drying: first feeding the lignite to X-ray dry sorting equipment, composite dry sorting equipment or fluidized-bed equipment for initial gangue removal to remove gangue partially, so as to reduce an energy loss in the lignite drying process; and allowing the lignite after the gangue removal to enter microwave, vibrating mixed-flow or fluidized-bed equipment for drying.

In the above solution, according to the quality of lignite, appropriate drying and dry sorting processes are selected, optimized and combined. Lignite has a high moisture content. Water mainly exists in free form in gaps between lignite particles and in large-diameter pores on the surface of lignite. The binding force of water is weak, and it is dominated by intermolecular forces. Such water is simple to remove and the required energy consumption is low. Therefore, the process of first dry sorting and then drying is selected to upgrade lignite. In the technical solution, before production, equation (1) is selected to pre-assess the calorific value of the coal, and equations (2) and (3) are combined for cost budgeting. Then, the degrees of deashing and drying are determined, so as to quantitatively control the production process. The water on the surface of lignite is easily affected by temperature, so after the coal enters the drying equipment, the free water on the surface of the lignite is quickly removed. This treatment meets the practical application requirements, improves the quality of lignite, and achieves the drying and ash reduction of the coal.

Advantages: By adopting the idea of integrated drying and dry sorting, the disclosure improves the quality of lignite. The disclosure meets the requirement for the surface moisture of the raw coal in the dry sorting operation, reduces the ash content of the coal, increases the calorific value of the coal and the output of clean coal, reduces the energy loss and production cost, and simplifies the process flow. The upgrading process features simple operation, high sorting efficiency, low energy consumption and low production cost, and realizes good economic and practical benefits.

DETAILED DESCRIPTION

Figure 1:
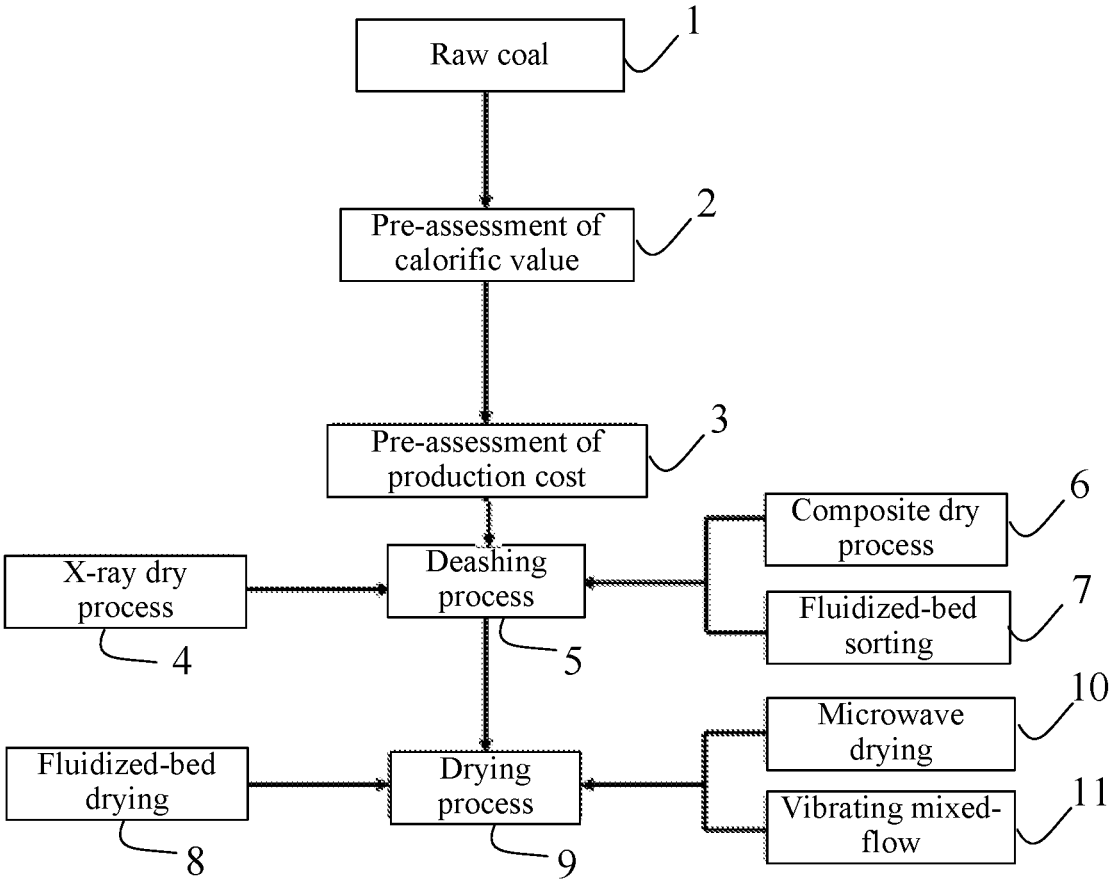
FIG. 1 is a flowchart of a process according to the disclosure.

As shown in FIG. 1, the disclosure provides an optimized upgrading method, including: selecting, optimizing and combining appropriate drying and dry sorting processes based on a relationship between a calorific value of lignite and a moisture content and an ash content thereof as well as a production cost required by a production process, and implementing the dry sorting process first and then the drying process 9:

(1) Before production, select a relational expression between the calorific value of the coal and a degree of metamorphism, the moisture content and the ash content thereof based on a ratio of the ash content to the moisture content, to pre-assess the calorific value 2 of the coal.

(2) Combine a relational expression between the production cost 3 and the ash content, and moisture content to make a cost budget;

(3) determine degrees of deashing and drying;

(4) and select a lignite ash reduction pretreatment process.

The relational expression between the calorific value of lignite and the ash content and moisture content thereof is as follows:

$$Q_{gr,d}=23.34-0.26285M_t-0.21954A_d+0.16979V_{ar}-0.00147V_{daf}^2 \quad (1)$$

In the equation, $Q_{gr,d}$ represents the calorific value of lignite, $M_t$ represents a total moisture content of the coal, $A_d$ represents the ash content of the coal, $V_{ar}$ represents the ash content of an as-received basis, and $V_{daf}$ represents a volatile content of a dry ash-free basis.

The relational expression between the production cost and the ash content and moisture content of the coal is as follows:

$$S = \omega \cdot M_{ad} + \gamma \cdot A_d \quad (2)$$

$$H_{MA} = \frac{\omega}{\gamma} \quad (3)$$

In the equation, $H_{MA}$ represents a tangent point between an iso-cost line and the calorific value, namely a lowest point of the production cost; S represents the production cost 3; $A_d$ represents the ash content of the coal; $M_{ad}$ represents the moisture content; ω represents a proportion of moisture removed during the sorting process; γ represents a proportion of ash removed during the sorting process.

The lignite ash reduction pretreatment process is a process to first preliminarily reduce ash or to deash 5, then dry the lignite 9: first feed the lignite to X-ray dry sorting equipment 4, composite dry sorting equipment 6 or fluidized-bed equipment 7 to deash and to partially remove gangue, so as to reduce an energy loss in the lignite drying process. After the deashing process 5 and the partial gangue removal, the lignite enters microwave 10, vibrating mixed-flow 11 or fluidized-bed equipment 8 to dry 9.

The disclosure is described in further detail below with reference to the accompanying drawings.

Figure 2:
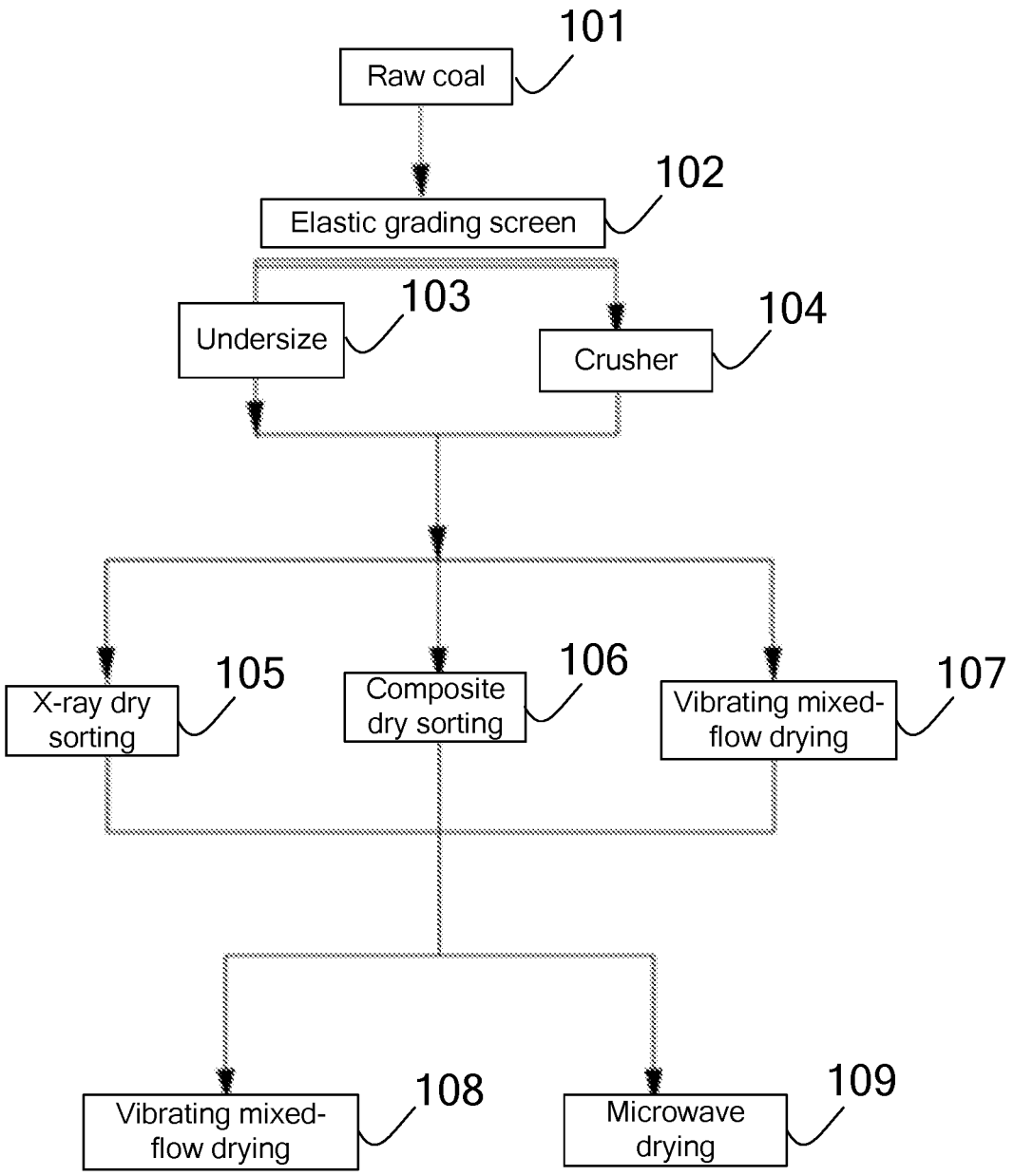
FIG. 2 is a flowchart of an example according to the disclosure.

Example 1: As Shown in FIG. 2

Step A: The final ash content and moisture content of lignite were determined by using two evaluation indicators, namely calorific value and production cost. Considering the high moisture content of lignite, the production process was determined as first preliminary gangue removal and then drying.

Step B: The lignite was fed to an elastic grading screen 102 through a chute by a belt conveyor for deep dry grading. The mesh size of the elastic screen was 30 mm. The oversize lignite larger than 30 mm entered a crusher 104. The coal discharged after crushing and the undersize coal 103 smaller than 30 mm filtered by the elastic grading screen entered X-ray dry sorting equipment 105, composite dry sorting equipment 106 or fluidized-bed equipment for initial gangue removal. In this way, part of the gangue was removed, so as to meet the ash reduction requirement.

Step C: The undersize lignite smaller than 30 mm filtered by the elastic grading screen and the lignite crushed by the crusher selectively entered vibrating mixed-flow, microwave and fluidized-bed equipment for micro drying treatment. The surface moisture of the coal was removed, and the drying was stopped when an expected drying purpose was achieved.

Step D: After the micro ash reduction treatment, the lignite entered the microwave 109, vibrating mixed-flow 108 or fluidized-bed equipment for drying, and after a certain period of drying treatment, a desired product was obtained.

What is claimed is:

1. A method for upgrading lignite comprising:

(1) prior to production, pre-assessing the calorific value of raw coal by selecting a relational expression between the calorific value of the coal and a degree of metamorphism, the moisture content and the ash content thereof based on a ratio of the ash content to the moisture content, and (2) making a cost budget by combining a relational expression between production cost the ash content, and moisture content;

(3) determining degrees of deashing and drying of the lignite, and;

(4) selecting and implementing a lignite ash reduction pretreatment process.

2. The method for upgrading lignite according to claim 1, wherein the relational expression between the calorific value of the lignite and the ash content and moisture content thereof is as follows:

$$Q_{gr,d}=23.34-0.26285M_t-0.21954A_d+0.16979V_{ar}-0.00147V_{daf}^2 \quad (1)$$

wherein, $Q_{gr,d}$ represents the calorific value of the lignite, $M_t$ represents a total moisture content of the coal, $A_d$ represents the ash content of the coal, $V_{ar}$ represents the ash content of an as-received basis, and $V_{daf}$ represents a volatile content of a dry ash-free basis.

3. The method for upgrading lignite according to claim 1, wherein the relational expression between the production cost (S) and the ash content ($A_d$) and moisture content ($M_{ad}$) of the coal is as follows:

$$S = \omega \cdot M_{ad} + \gamma \cdot A_d \quad (2)$$

$$H_{MA} = \frac{\omega}{\gamma} \quad (3)$$

wherein, $H_{MA}$ represents a tangent point between an iso-cost line and the calorific value, namely a lowest point of the production cost; S represents the production cost; $A_d$ represents the ash content of the coal; $M_{ad}$ represents the moisture content; ω represents a proportion of moisture removed during the sorting process; γ represents a proportion of ash removed during the sorting process.

4. The method for upgrading lignite by according to claim 1, wherein the lignite ash reduction pretreatment process comprising:

1) feeding the lignite to X-ray dry sorting equipment, composite dry sorting equipment or fluidized-bed equipment to partially remove gangue, so as to reduce an energy loss in the lignite drying process; and
2) allowing the lignite after the gangue removal to enter microwave, vibrating mixed-flow or fluidized-bed equipment for drying.

* * * * *